United States Patent [19]

Martin

[11] Patent Number: 4,951,828

[45] Date of Patent: Aug. 28, 1990

[54] TOOTHBRUSH RACK DEVICE

[76] Inventor: Edward J. Martin, 3388 Reedy Dr., Annandale, Va. 22003

[21] Appl. No.: 895,919

[22] Filed: Aug. 13, 1986

[51] Int. Cl.[5] ..... A47B 81/00

[52] U.S. Cl. ..... 211/65; 211/88

[58] Field of Search ..... 211/65, 13, 60.1, 67, 211/71, 88, 126, 189; 248/312, 312.1, 315, 311.2, 221.3, 110

[56] References Cited

U.S. PATENT DOCUMENTS

| | | | |
|---|---|---|---|
| 712,824 | 11/1902 | Masland | 211/65 X |
| 2,916,154 | 12/1959 | Elliott | 211/65 |
| 2,916,155 | 12/1959 | Elliott | 211/665 |
| 3,002,630 | 10/1961 | Heisser | 211/65 |
| 3,685,660 | 8/1972 | Saunders | 211/65 X |

*Primary Examiner*—Carl D. Friedman
*Assistant Examiner*—Sarah A. Lechok
*Attorney, Agent, or Firm*—Fred Philpitt

[57] ABSTRACT

A two-piece device for holding a plurality of toothbrushes which comprises a wall mountable unit having the overall shape and configuration of a hemisphere, an arcuate recessed groove extending midway through the hemisphere and a general arcuate and planar rack member having openings for holding a plurality of toothbrushes, the rack member engages the arcuate recessed groove of the wall mountable unit.

1 Claim, 3 Drawing Sheets

Fig. 1
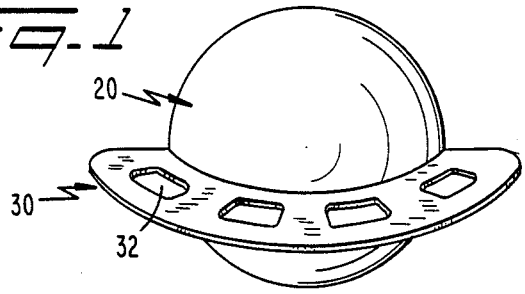
Fig. 2
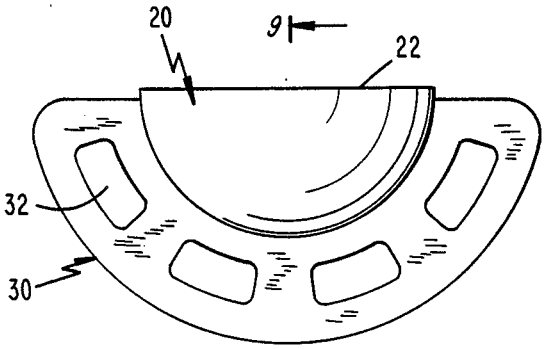
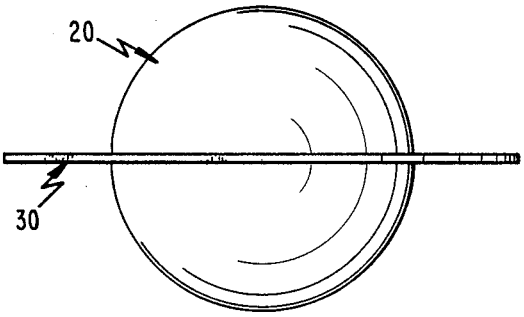
Fig. 3
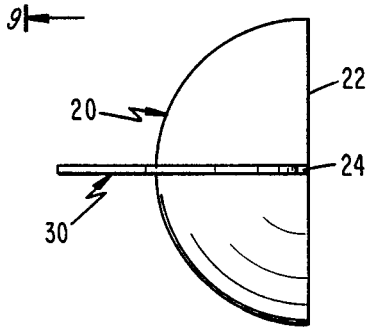
Fig. 4
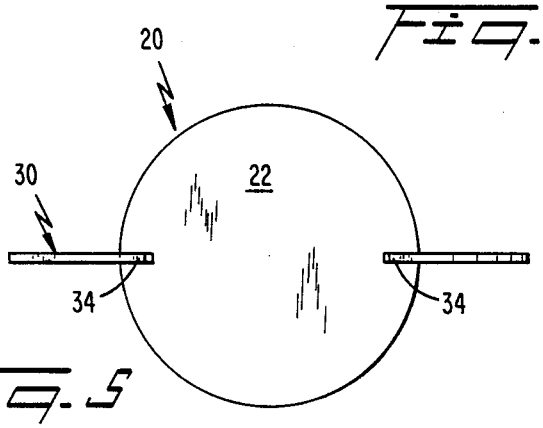
Fig. 5

TOOTHBRUSH RACK DEVICE

The present invention pertains to a two-piece device for holding a plurality of toothbrushes and is characterized by a rack member that may be readily removed and replaced as the users of the device change.

When people travel and stop at hotels or motels there is a frequently considerable reluctance for the room occupant to place his toothbrush in the permanent toothbrush racks that are provided because of the doubt as to whether or not the rack is really clean and germ-free. As a result such racks are often not used.

The object of this invention is to provide a toothbrush rack device that permits the rack to be easily and quickly removed each time the occupancy of a room changes. Considered from one aspect my invention involves a device for holding a plurality of toothbrushes or the like which comprises in combination:

(a) a wall mountable unit that on its backside contains means for attaching the unit to a wall and its front side contains an arcuate recessed groove.

(b) A generally arcuate and planar rack member that is configured and dimensioned so that an inner portion of said arcuate rack member will fit into the arcuate recessed groove of said wall mountable unit and the remainder of said rack member extends outwardly from said recessed groove and provides means for holding a plurality of toothbrushes, and, (c) engagement means associated with said wall mountable unit and engagement means associated with said arcuate rack member, which when brought into a cooperative-engaging relationship releasably hold said rack member in place in said wall mountable unit so that the device can receive and maintain the position of a plurality of toothbrushes.

My invention will be better understood by referring to the attached drawings wherein;

FIG. 1 is a front perspective view of a preferred embodiment of my device in its assembled condition;

FIG. 2 is a plan view of FIG. 1;

FIG. 3 is a front view of FIG. 1;

FIG. 4 is a side view of FIG. 1;

FIG. 5 is a rear view of FIG. 1;

Figure 6:
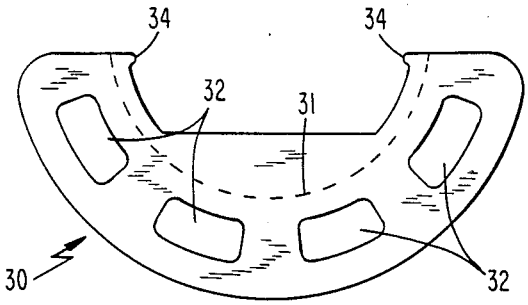
FIG. 6 is a plan view of my planar rack member.

Referring now to the drawings, FIGS. 1-5 and 9 show various views of my device in its assembled condition and which comprises only two main parts, the wall mountable unit 20 and the rack member 30. The rack member 30 has a plurality of holes or openings (32) to accomodate tooth brushes. The wall mountable unit 20 is shown in a preferred form as having the overall general configuration of a hemisphere, and the rack member 30 fits into a groove or slot 24 in this hemisphere at approximately the midline of said hemisphere. The backside of the wall mountable unit 20 preferably consists of a flat planar surface 22 that has a coating of adhesive on it so that it may readily be affixed to a wall surface by simply pressing the adhesively coated planar surface 22 against a wall. The adhesive should be strong enough to hold the unit 20 in place under the ordinary conditions of usage, which primarily involves supporting the weight of several toothbrushes. However, any other suitable means could be employed for affixing the wall mountable wall unit 20 to a wall, such as by screws, bolts, brackets, prongs, etc.

The rack member 30 is shown by itself in FIG. 6. In addition to the holes or openings 32, the rack member has ears 34 at its inner ends that are adapted to engage corresponding projections 27 in the groove or slot 24 of the wall mountable unit 20. The dashed line 31 in FIG. 6 is provided to indicate the portion of the rack member 30 that fits into the slot 24 of the wall unit 20.

Figure 7:
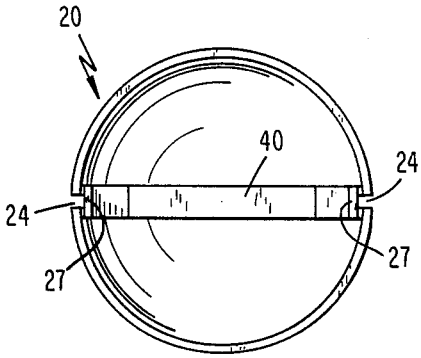
FIG. 7 is a rear view of my wall mountable unit without rack member.
Figure 8:
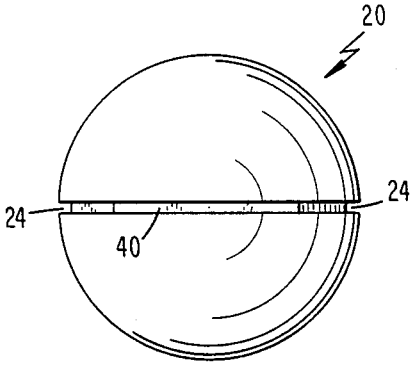
FIG. 8 is a front view of my wall mountable unit without rack member.
Figure 9:
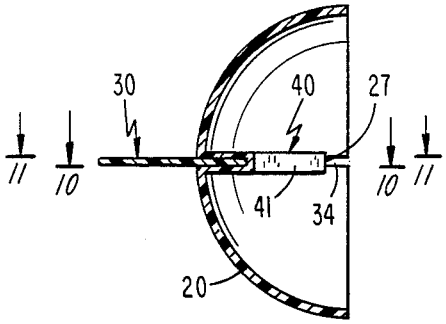
FIG. 9 is a sectional view along 9—9 of FIG. 2.
Figure 10:
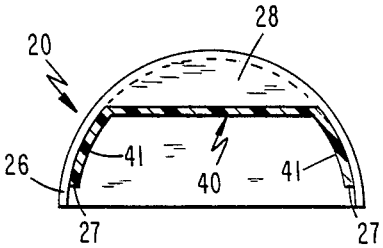
FIG. 10 is a sectional view along 10—10 of FIG. 9.
Figure 11:
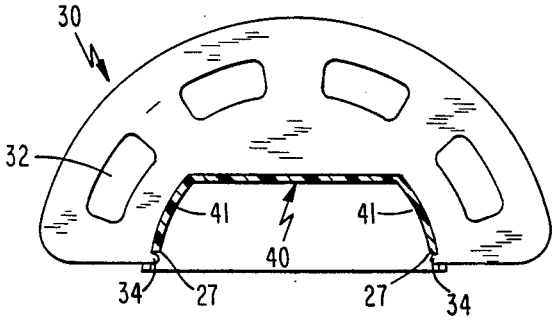
FIG. 11 is a sectional view along 11—11 of FIG. 9.
Figure 12:
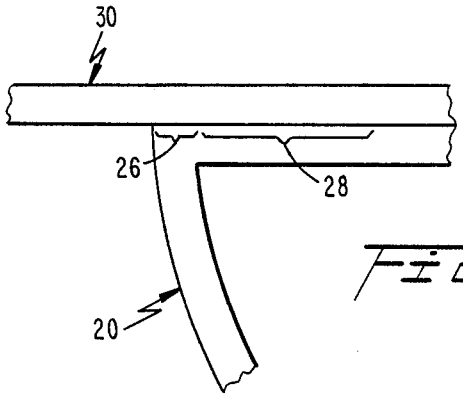
FIG. 12 is an enlarged fragmented view of the rack 30 of FIG. 9.

FIGS. 7 and 8 show rear and front views of the wall mountable unit 20 without the rack member 30, and FIG. 10 shows a cross sectional view through 10—10 of FIG. 9 which reveals that the slot 24 is formed by both an upper lip surface 26 of the lower half of unit 20 and by an inwardly extending shelf surface portion 28. When the rack member 30 is inserted into the slot 24 it lodges therein and is supported therein as is indicated by FIGS. 9 and 11. FIG. 12 is an enlarged fragmented view (without cross hatching) to illustrate that the rack member 30 is supported by both the upper lip surface 26 cf the lower half of unit 20 as well as by the shelf surface portion 28.

FIG. 7-12 show that the slot or groove 24 and the shelf surface portion 28 can be suitably formed by an interior member 40 that is best shown in FIGS. 9 and 10 and is seen to comprise an arcuate and generally U-shaped section that is preferbly integrally formed on the interior portion of the hemisphere 20. The central portion of the interior member 40 comprises a shelf surface portion 28 (as shown in FIGS. 10 and 12) and the side portions 41 extending laterally outwardly from each side of the shelf surface portion 28, terminating in the projections 27 that engage the ears 34 of the rack member. The size and shape of the ears 34 in relation to the projections is such that by relatively little finger pressure or manual manipulation the rack member 30 can be readily engaged or disengaged from the wall mountable unit 20.

A very convenient advantage of my device is that once the wall mountable unit has been mounted on a wall by adhering the adhesively coated back 22 to a wall, and a rack member 30 inserted in the slot 24, the rack member can thereafter be easily removed and replaced by a fresh clean rack member 30 after one day or after the persons using the rack change (as in a hotel or motel). The ability of a maid to easily and quickly change the rack member each time the occupancy of a hotel or motel room changes eliminates the reluctance that many people would have placing their toothbrush in a toothbrush rack located in a hotel or motel room. Also, the rack member is so easily changed that each new occupant can make his or her own change.

My device is preferably made of plastic material so that it is light in weight, will not rust or corrode and is easy to clean. If the wall unit becomes too dirty, damaged or stained it too can be removed and replaced without a great deal of difficulty.

In conclusion, while the foregoing specification and drawing describe the construction, operation and use of a preferred embodiment of my invention, it is to be understood that I do not intend to limit myself to the precise constructions and configurations and arrangements herein disclosed and shown, since the various details of construction, shape, form and arrangement may obviously be varied to a considerable extent by anyone skilled in the art without really departing from the basic principles and novel teachings of my invention and without sacrificing any of the advantages of my invention, and accordingly, it is intended to encompass all changes, variations, modifications and equivalents of the appended claims.

What is claimed is:

1. A device mountable on the wall of a bathroom for holding a plurality of toothbrushes, said device comprising the combination of (a) a wall mountable unit having an overall shape and configuration approximating a hemisphere, (1) the flat side portion of said hemisphere containing means for attachment to a vertical wall, and (2) the remaining portion of said hemisphere being bisected by an arcuate recessed groove extending partially into the interior of said hemisphere, said arcuate groove being located in a single horizontal plane that is parallel to the floor of the bathroom, and (b) a generally arcuate and planar rack member having an inner portion and an outer portion (1) that is configured and dimensioned so that the inner portion thereof will fit into and within said arcuate recessed groove of said hemisphere and the remaining outer portion thereof will extend outwardly from said arcuate recessed groove, (2) said planar rack member containing means for holding a plurality of toothbrushes, and (3) containing on its inner portion at least one inwardly extending projection that is adapted to releasably engage a portion of said arcuate recessed groove of said hemisphere so that said rack member can be readily engaged with said arcuate recessed groove by manual pushing and can be readily disengaged from said arcuate recessed groove by manual pulling.

* * * * *